US007396142B2

(12) United States Patent
Laizure, Jr. et al.

(10) Patent No.: US 7,396,142 B2
(45) Date of Patent: Jul. 8, 2008

(54) LED LIGHT BULB

(75) Inventors: Robert S. Laizure, Jr., Surprise, AZ (US); Wojciech Pawelko, Deer Park, NY (US); Lee C. Cote, Las Vegas, NV (US); Peng Jin, Lodi, NJ (US)

(73) Assignee: Five Star Import Group, L.L.C., Surprise, AZ (US)

( * ) Notice: Subject to any disclaimer, the term of this patent is extended or adjusted under 35 U.S.C. 154(b) by 51 days.

(21) Appl. No.: 11/343,450

(22) Filed: Jan. 30, 2006

(65) Prior Publication Data

US 2006/0215422 A1 Sep. 28, 2006

Related U.S. Application Data

(60) Provisional application No. 60/665,127, filed on Mar. 25, 2005.

(51) Int. Cl.
*F21V 1/00* (2006.01)

(52) U.S. Cl. ..... 362/240; 362/650; 362/800; 313/318.01

(58) Field of Classification Search ..... 362/650, 362/240, 238, 525, 97, 800; 349/70; 313/49, 313/51, 318.01, 318.03, 318.05
See application file for complete search history.

(56) References Cited

U.S. PATENT DOCUMENTS

| | | | | |
|---|---|---|---|---|
| 1,064,571 | A | | 6/1913 | Triquet |
| 1,678,606 | A | | 7/1928 | Singer |
| 2,406,271 | A | | 8/1946 | Van Horn |
| 2,517,126 | A | | 8/1950 | Macksoud |
| 2,799,421 | A | | 7/1957 | Wildeboer |
| D218,977 | S | | 10/1970 | Venema |
| 4,211,955 | A | | 7/1980 | Ray |
| D262,405 | S | | 12/1981 | Zabransky |
| 4,727,289 | A | | 2/1988 | Uchida |
| D302,860 | S | | 8/1989 | Anema |
| D354,146 | S | | 1/1995 | Chamberlain et al. |
| 5,463,280 | A | | 10/1995 | Johnson |
| 5,506,760 | A | | 4/1996 | Giebler et al. |
| 5,526,236 | A | * | 6/1996 | Burnes et al. ..... 362/20 |
| 5,575,459 | A | | 11/1996 | Anderson |
| 5,632,551 | A | * | 5/1997 | Roney et al. ..... 362/485 |
| 5,655,830 | A | | 8/1997 | Ruskouski |
| D385,051 | S | | 10/1997 | Wu |
| 5,688,042 | A | | 11/1997 | Madadi et al. |
| 5,726,535 | A | | 3/1998 | Yan |

(Continued)

*Primary Examiner*—Sandra L. O'Shea
*Assistant Examiner*—Gunyoung T. Lee
(74) *Attorney, Agent, or Firm*—Gerald E. Hespos; Anthony J. Casella; Michael J. Porco

(57) ABSTRACT

A light emitting diode (LED) light bulb configured to replicate the light output of a conventional incandescent light bulb is provided. The LED light bulb includes a base for coupling the bulb to a power source having at least one side wall defining a cavity; a generally rectangular substrate having a first end and a second end, the second end disposed in the cavity and electrically coupled to the base; a plurality of LEDs electrically coupled and disposed on the first end of the substrate, the plurality of LEDS arranged on a front face, back face and top edge of the first end of the substrate to emit light in a spherical output; and a light transmissive cover configured to enclose the plurality of LEDs, the cover being coupled to the base.

11 Claims, 8 Drawing Sheets

U.S. PATENT DOCUMENTS 5,806,965 A * 9/1998 Deese ..... 362/249
5,857,767 A * 1/1999 Hochstein ..... 362/294
D405,201 S 2/1999 Lodhie
5,890,794 A * 4/1999 Abtahi et al. ..... 362/294
5,949,347 A 9/1999 Wu
D415,293 S 10/1999 Kato et al.
D415,582 S 10/1999 Camarota
D418,928 S 1/2000 Zhang et al.
D420,155 S 2/2000 Kato et al.
D422,100 S 3/2000 Zhang et al.
6,045,240 A 4/2000 Hochstein
D432,684 S 10/2000 Yim
D432,685 S 10/2000 Yim
6,132,072 A 10/2000 Turnbull et al.
D434,510 S 11/2000 Lodhie
6,161,910 A * 12/2000 Reisenauer et al. ..... 315/309
6,220,722 B1 4/2001 Begemann
6,227,679 B1 5/2001 Zhang et al.
6,425,678 B1 * 7/2002 Verdes et al. ..... 362/244
6,461,008 B1 * 10/2002 Pederson ..... 362/35
6,462,475 B1 10/2002 Lee
6,499,860 B2 12/2002 Begemann
6,547,417 B2 4/2003 Lee
6,598,996 B1 7/2003 Lodhie
D479,615 S 9/2003 Kakuno et al.
D479,886 S 9/2003 Kakuno et al.
6,621,222 B1 9/2003 Lodhie
6,626,557 B1 * 9/2003 Taylor ..... 362/249
D480,486 S 10/2003 Kakuno et al.
6,709,132 B2 3/2004 Ishibashi
D493,004 S 7/2004 Hoshikawa et al.
6,791,840 B2 9/2004 Chun
6,827,469 B2 * 12/2004 Coushaine et al. ..... 362/294
6,844,824 B2 * 1/2005 Vukosic ..... 340/815.65
7,086,767 B2 * 8/2006 Sidwell et al. ..... 362/545
7,158,019 B2 * 1/2007 Smith ..... 340/467
2002/0149933 A1 * 10/2002 Archer et al. ..... 362/234
2003/0040200 A1 2/2003 Cao
2004/0022057 A1 * 2/2004 Lee ..... 362/238
2004/0150995 A1 8/2004 Coushaine et al.
2004/0184272 A1 9/2004 Wright et al.
2004/0223320 A1 11/2004 Archer et al.
2005/0068776 A1 3/2005 Ge
2005/0162866 A1 7/2005 Osawa
2005/0243550 A1 * 11/2005 Stekelenburg ..... 362/240
2006/0082315 A1 * 4/2006 Chan ..... 315/46

* cited by examiner

LED LIGHT BULB

This application claims priority to an application entitled "LED LIGHT BULB" filed in the United States Patent and Trademark Office on Mar. 25, 2005 and assigned Ser. No. 60/665,127, the contents of which are hereby incorporated by reference.

BACKGROUND OF THE INVENTION

1. Field of the Invention

The present disclosure relates generally to light bulb and lamp assemblies, and more particularly, to a light emitting diode (LED) light bulb configured to replicate the light output of a conventional incandescent light bulb.

2. Description of the Related Art

Incandescent light bulbs are used in a large variety of lighting products. Although inexpensive to purchase, incandescent light bulbs have several drawbacks. First, incandescent light bulbs use a relatively large amount of power compared to other lighting products which increase energy costs. Second, incandescent light bulbs have a short life causing repetitive replacement costs. Furthermore, since theses bulbs have a short life, labor costs will subsequently be effected by having maintenance personnel constantly replace the bulbs.

Thus, a need exists for a lighting product having low power consumption and long life. Furthermore, a need exists for the lighting product to produce the same light output as a conventional incandescent bulb.

SUMMARY OF THE INVENTION

A light emitting diode (LED) light bulb is provided. The LED light bulb includes a base for coupling the bulb to a power source, a substrate, e.g., a printed circuit board (PCB), coupled to the base and for supporting a plurality of LEDs, and a cover for protecting the plurality of LEDs. The plurality of LEDs are arranged on the PCB to replicate the light output of a conventional incandescent light bulb. By employing a plurality of LEDs for the lighting product, the light bulb of the present disclosure will have a longer product life and lower power consumption than conventional incandescent light bulbs.

According to one aspect of the present disclosure, an LED light bulb is provided. The LED light bulb includes a base for coupling the bulb to a power source having at least one side wall defining a cavity; a generally rectangular substrate having a first end and a second end, the second end disposed in the cavity and electrically coupled to the base; a plurality of LEDs electrically coupled and disposed on the first end of the substrate, the plurality of LEDS arranged on a front face, back face and top edge of the first end of the substrate to emit light in a spherical output; and a light transmissive cover configured to enclose the plurality of LEDs, the cover being coupled to the base. The top edge of the first end of the substrate further includes at least one notch configured to receive at least one LED.

According to another aspect of the present disclosure, an LED light bulb includes a base for coupling the bulb to a power source having at least one side wall defining a cavity; a generally rectangular substrate having a first end and a second end, the second end disposed in the cavity and electrically coupled to the base; a plurality of LEDs electrically coupled and disposed on the first end of the substrate, wherein a solder mask is disposed on the substrate to reflect light generated by the plurality of LEDs and to emit light in a spherical output; and a light transmissive cover configured to enclose the plurality of LEDs, the cover being coupled to the base. A color of the solder mask may be white, copper or amber.

According to a further aspect of the present disclosure, an LED light bulb includes a base for coupling the bulb to a socket of a power source having at least one side wall defining a cavity, the base including a threaded portion for insertion into the socket and a skirted portion for receiving a cover; a generally rectangular substrate having a first end and a second end, the second end disposed in the cavity and electrically coupled to the base, the substrate including a tab projecting from each side edge located adjacent the second end of the substrate configured for mating with the skirted portion of the base; a plurality of LEDs electrically coupled and disposed on the first end of the substrate, the plurality of LEDS arranged on a front face, back face and top edge of the first end of the substrate to emit light in a spherical output; and a light transmissive cover configured to enclose the plurality of LEDs, the cover including a recessed portion at an open end for mating with the skirted portion of the base, wherein the recessed portion of the cover further comprises two slots configured to receive the tabs of the substrate.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE PREFERRED EMBODIMENTS

Figure 1:
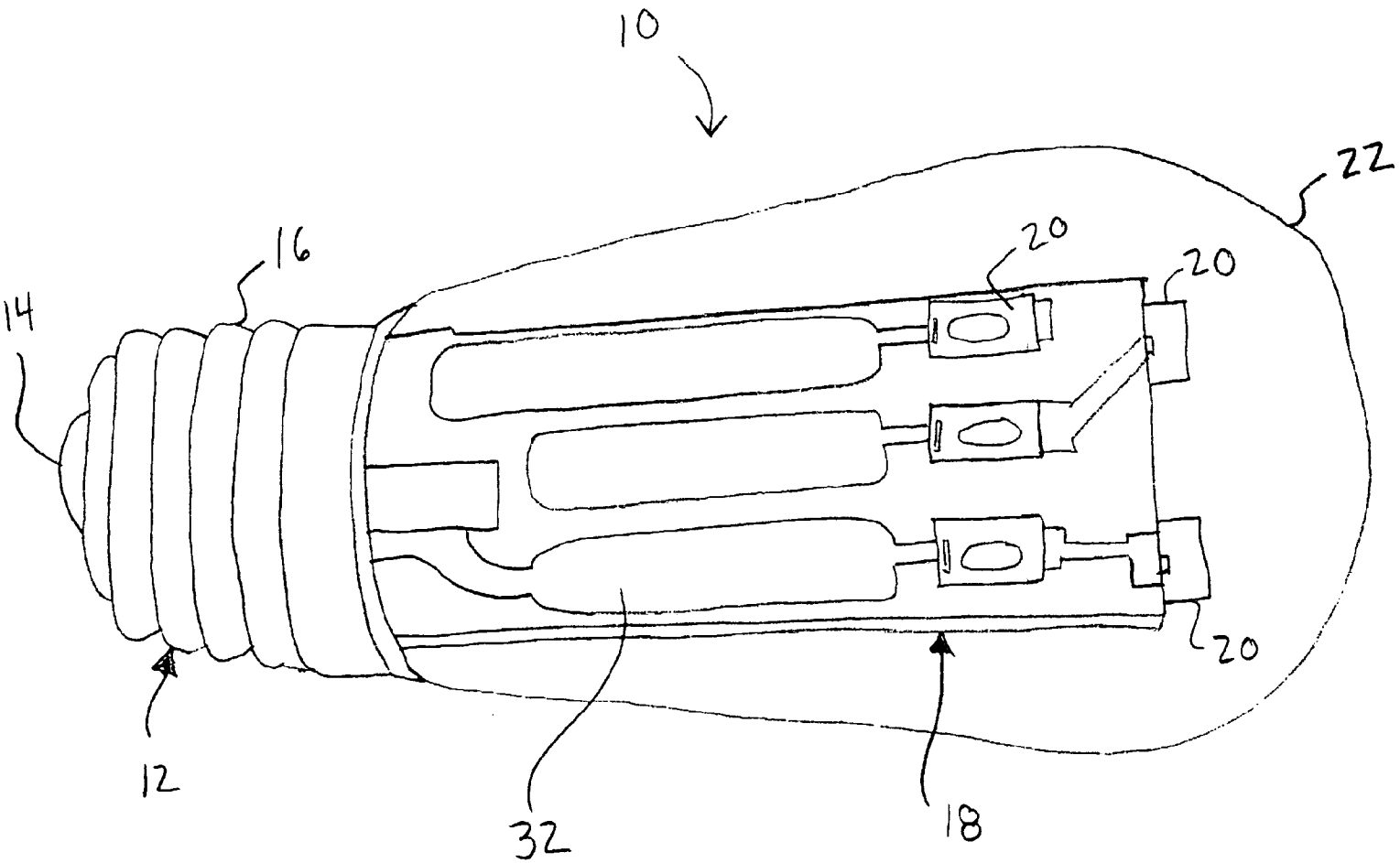
FIG. 1 is perspective view of a LED light bulb in accordance with an embodiment of the present disclosure.

Preferred embodiments of the present disclosure will be described hereinbelow with reference to the accompanying drawings. In the following description, well-known functions or constructions are not described in detail to avoid obscuring the invention in unnecessary detail. Throughout the drawings, like reference numerals represent like elements.

Referring to FIG. 1, a light emitting diode (LED) light bulb 10 according to an embodiment of the present disclosure is shown. The LED light bulb 10 includes a base 12 for coupling the bulb 10 to a power source, e.g., a conventional socket of a lamp. The base 12 includes an inner terminal 14 and an outer terminal 16 which is preferably threaded for screwing the base 12 into the conventional socket which is connected to an AC power source, e.g., 120VAC, 12VDC, 24VDC. The base 12 is preferably made from an electrically conductive metal or any known conductive material employed by those skilled in the art.

A substrate 18 is configured to be mounted to the base 12 and for supporting a plurality of LEDs 20. Preferably, the substrate 18 is a printed circuit board (PCB) and each of the plurality of LEDs 20 is soldered to the PCB 18. An exemplary LED is model NSSL100T commercially available from Nichia Corporation of Japan, which is a 4 volt, 20 mA LED. Preferably, the PCB 18 will be of a copper or white color to give a warmer color to the light being reflected off the PCB and thus more resembling an incandescent bulb.

Figure 2A:
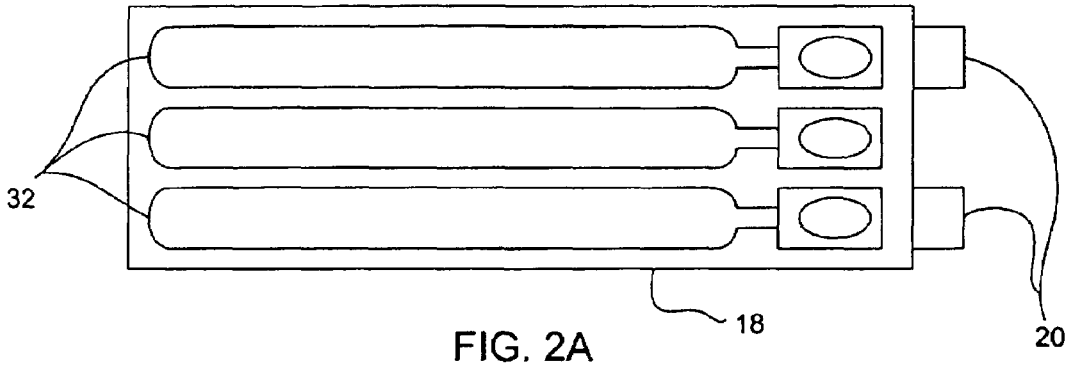
FIG. 2A is right side view of a printed circuit board of the LED bulb shown in FIG. 1.
Figure 2B:
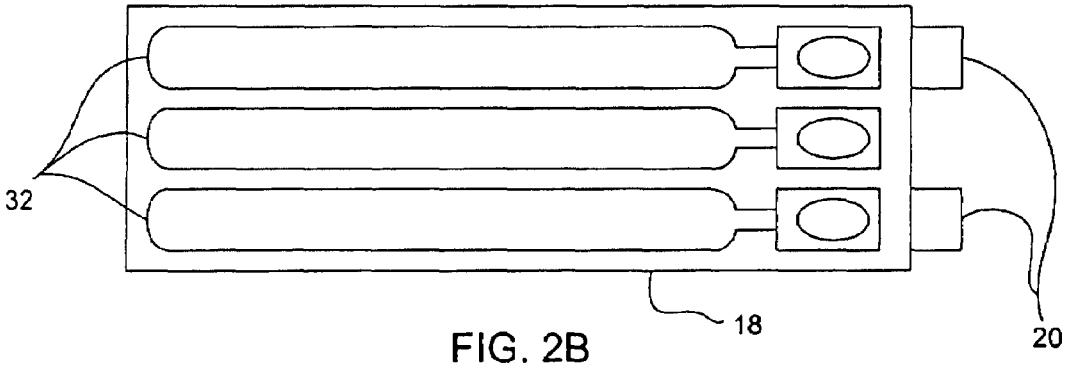
FIG. 2B is a left side view of a printed circuit board of the LED bulb shown in FIG. 1.
Figure 2C:
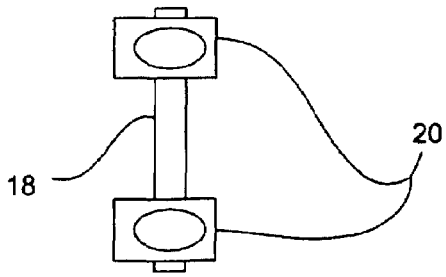
FIG. 2C is a top plan view of a printed circuit board of the LED bulb shown in FIG. 1.

Referring to FIGS. 2A-2C, a layout of the plurality of LEDs on the PCB 18 is illustrated. According to the embodiment shown, three LEDs are mounted on one side of the PCB 18 (FIG. 2A), three LEDs are mounted on the opposite side of the PCB 18 (FIG. 2B) and two LEDs are mounted on an edge of the PCB 18 (FIG. 2C). The LED configuration shown replicates the light output of a conventional incandescent light bulb. The light output for the embodiment shown throughout the figures is about 73 foot candles (fc) from the top of the bulb 10, about 85 to about 90 fc from the sides of the bulb 10 and about 70 to about 80 fc from the bottom of the bulb 10.

The bulb 10 further includes a light transmissive cover 22 for environmentally sealing the components of the bulb. Preferably, the cover 22 is made from a polycarbonate material but may be composed of acrylic or glass. The cover 22 may be formed with a particular color depending on the application. Furthermore, the bulb 10 does not require an inert gas to be sealed within the cover 22 nor does it require the space internal the cover 22 to be evacuated thereby simplifying the manufacturing process.

Figure 3:
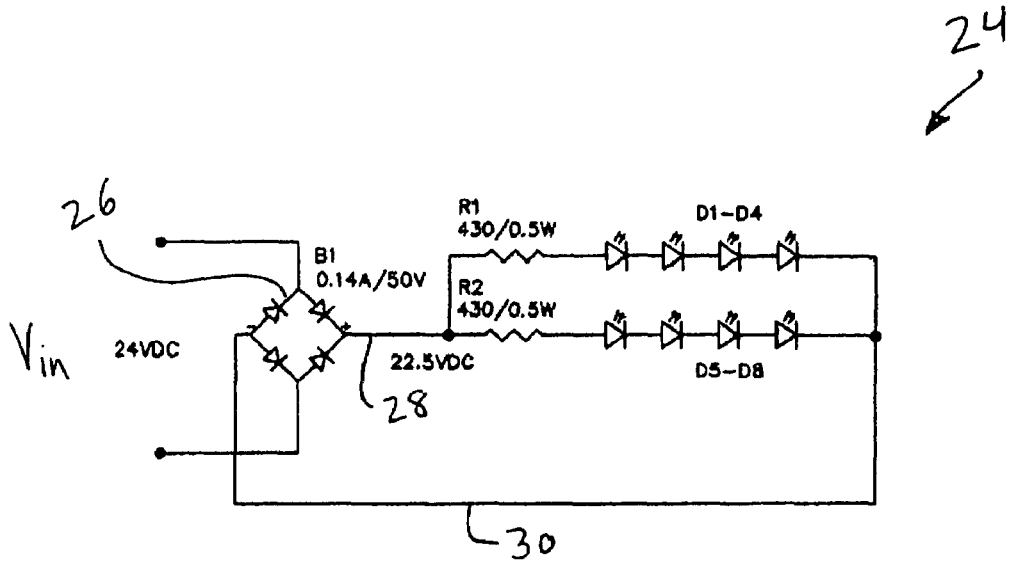
FIG. 3 is a schematic diagram of a driving circuit for driving a plurality of LEDs of the LED light bulb according to an embodiment of the present disclosure.

Referring to FIG. 3, a driving circuit 24 for driving the plurality of LEDs 20 of the LED light bulb 10 is illustrated. The driving circuit 24 includes a bridge rectifier 26 for receiving input power Vin, e.g., an AC or DC power source, and converting the input power Vin to DC voltage, e.g., 22.5 volts. It is to be appreciated the bridge rectifier 26 permits reverse polarity of the DC power input making the input power polarity independent. The DC voltage is applied to the LEDs, here shown as D1 . . . D8, via supply main 28 and return main 30. In this embodiment, Vin is 24VDC and there are two branches of LEDs coupled in parallel. The first branch includes a first resistor R1 wired in series with four LEDs D1-D4 and the second branch includes a second resistor R2 wired in series with four LEDs D5-D8. The values shown in FIG. 3 for R1, R2, etc. are merely exemplary and are not meant to limit any embodiment of the present disclosure to the values shown. As best shown in FIGS. 2A-2C, the mains 28, 30 for applying DC voltage are configured as wide copper lines 32 on the PCB 22 to facilitate the dissipation of heat generated by the bulb to the base and through the socket to ensure long life of the LEDs, as well as the mains dissipating heat themselves.

Figure 4:
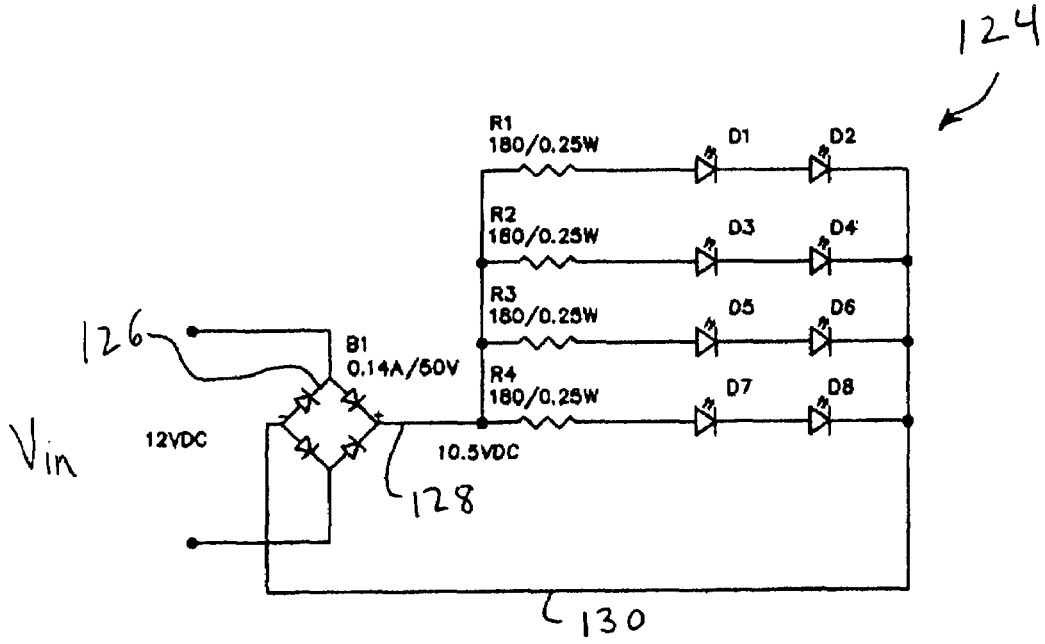
FIG. 4 is a schematic diagram of a driving circuit for driving a plurality of LEDs of the LED light bulb according to another embodiment of the present disclosure.

Referring to FIG. 4, another embodiment of a driving circuit 124 for driving the plurality of LEDs 20 of the LED light bulb 10 is illustrated. Similar to the embodiment shown in FIG. 3, the driving circuit 124 includes a bridge rectifier 126 for receiving input power Vin, e.g., 12VDC, and converting the input power Vin to DC voltage, e.g., 10.5 volts. The DC voltage is applied to the LEDs, here shown as D1 . . . D8, via supply main 128 and return main 130. In this embodiment, Vin is 12VDC and there are four branches of LEDs coupled in parallel. The first branch includes a first resistor R1 wired in series with two LEDs D1-D2, the second branch includes a second resistor R2 wired in series with two LEDs D3-D4, the third branch includes a third resistor R3 wired in series with two LEDs D5-D6, and the fourth branch includes a fourth resistor R4 wired in series with two LEDs D7-D8. The values shown in FIG. 4 for R1, R2, R3, R4, etc. are merely exemplary and are not meant to limit any embodiment of the present disclosure to the values shown.

In one embodiment, the LED light bulb of the present disclosure is configured as a replacement for a standard 6S6 candelabra, 6 watt decorative light bulb, i.e., the base and cover have similar dimensions to the conventional 6S6 bulb. These types of bulbs are used in the entertainment industry (theme parks), casinos to enhance architectural structures and numerous other commercial and residential applications.

Figure 6:
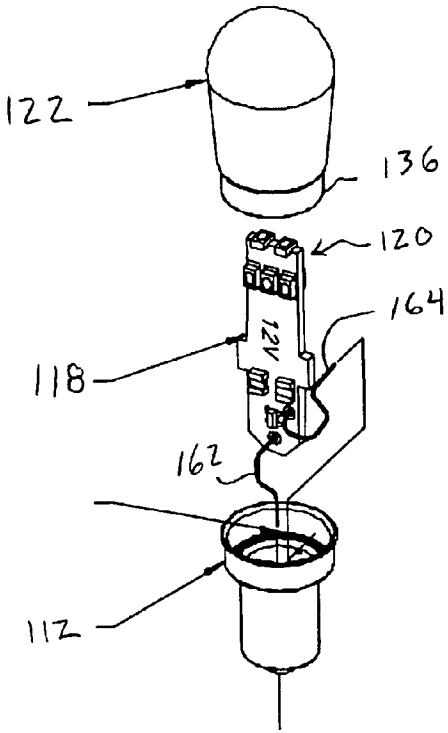
FIG. 6 is an exploded view of the LED light bulb shown in FIG. 5.
Figure 5:
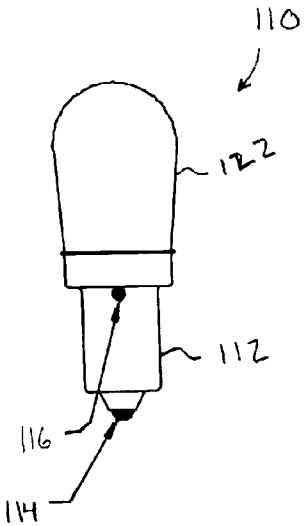
FIG. 5 is a side view of a LED light bulb in accordance with another embodiment of the present disclosure.

Referring to FIGS. 5 and 6, an LED light bulb 110 according to another embodiment of the present disclosure is illustrated. The LED light bulb 110 includes a base 112 for coupling the bulb 110 to a power source, e.g., a conventional socket of a lamp, a substrate or printed circuit board 118 electrically coupled to the base 112 and for supporting a plurality of LEDs 120 and a cover 122 for protecting the plurality of LEDS 120.

Figure 7:
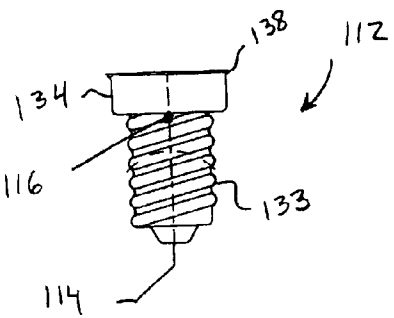
FIG. 7 is a side view of a base of the LED light bulb in accordance with the present disclosure.

The base 112 includes a threaded portion 133, as illustrated in FIG. 7, for screwing the base 112 into a conventional socket which is connected to an AC power source, e.g., 120VAC, 12VDC, 24VDC. Although not shown, the present disclosure contemplates other types of bases beside the threaded type for example, a bayonet type base, etc. The base further includes a skirted portion 134 for receiving a bottom rim 136 of the cover 122. By providing the skirted portion 134 and the bottom rim 136 of the cover, a large surface area is created for mounting the cover 122 to the base 112 lending stability to the design. Furthermore, the skirted portion 134 creates a greater thermally conductive surface area to aid in heat dissipation especially when the skirted portion is exposed to outside air, e.g., convection cooling. The threaded portion 133 and skirted portion 134 define a cavity for receiving the substrate 118 as will be described below. The base also includes a lip portion 138 extending from an upper peripheral edge of the skirted portion 134. As will be described below, the lip portion of the base will come into contact with a gasket for environmentally sealing the light bulb 110 when mounted in a socket.

The base 112 Includes an inner terminal 114 and an outer terminal 116 for receiving power from the socket and transferring the power to a driving circuit mounted on the substrate 118. The base 12 is preferably made from an electrically conductive metal or any known conductive material employed by those skilled in the art, e.g., nickel coated brass.

The substrate 118 is configured to be mounted to the base 112 and for supporting a plurality of LEDs 120. Preferably, the substrate 118 is a printed circuit board (PCB) and each of the plurality of LEDs 120 is soldered to the PCB 118. Preferably, each LED 120 is a SMD (surface mount device) type LED which is generally rectangular having the LED chip on a front face and an anode and cathode on a back face. An exemplary SMD-type LED is model NSSL100T commercially available from Nichia Corporation of Japan. By employing a SMD-type LED, the LED can be mounted and soldered flush on the substrate resulting in a small form factor with increased structural integrity as opposed to the use of prior art lead type LED lamps.

Figure 8A:
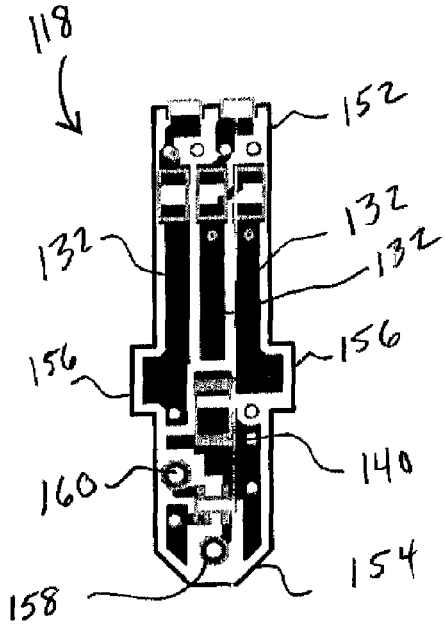
FIG. 8A is a top plan view of a 24 volt printed circuit board and FIG. 8B is a bottom view of a 24 volt printed circuit board.
Figure 8B:
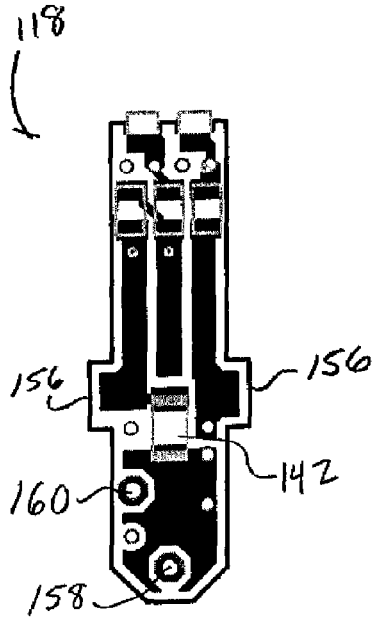
Figure 9A:
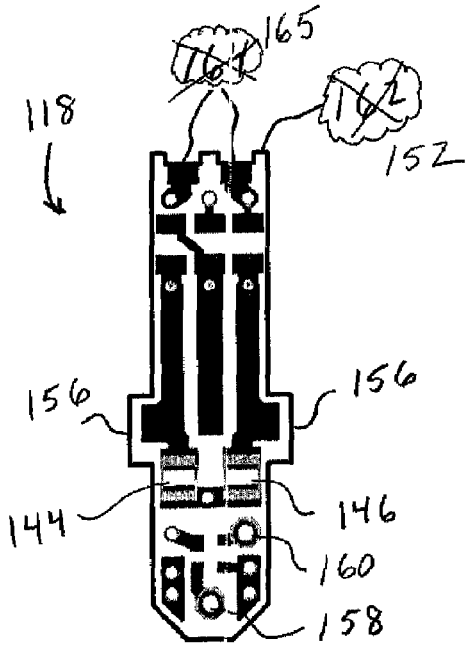
FIG. 9A is a top plan view of a 12 volt printed circuit board and FIG. 9B is a bottom view of a 12 volt printed circuit board.
Figure 9B:
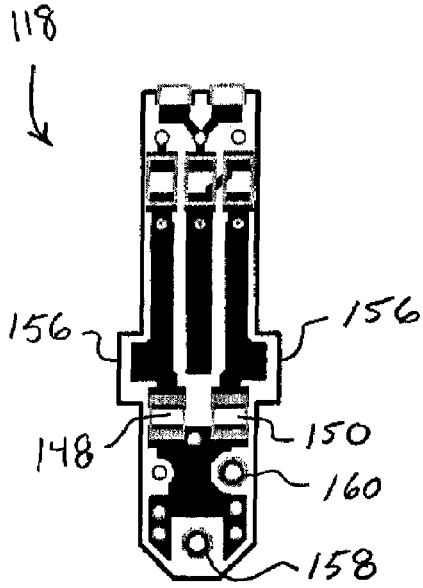

Referring to FIGS. 8A-9B, the substrate or printed circuit board 118 is illustrated where FIG. 8A is a top view of a 24 volt substrate, FIG. 8B is a bottom view of the 24 volt substrate, FIG. 9A is a top view of a 12 volt substrate and FIG. 9B is a bottom view of the 12 volt substrate. It is to be appreciated that although shown in the figures as one board, the substrate may be composed of several layers of individual printed circuit boards or insulating material such as a fiberglass-epoxy composite material. For example, in one embodiment, the substrate may include two layers a top layer similar to the layer shown in FIG. 8A and a bottom layer similar to the layer shown in FIG. 8B. In a further embodiment, the substrate may include four layers, a top layer similar to the layer shown in FIG. 8A, a bottom layer similar to the layer shown in FIG. 8B, and two internal layers therebetween which are mostly copper, i.e., an electrically conducting material, to help dissipate heat from the LEDs to the base. Although structurally and functionally similar, the 24 volt substrate and 12 volt substrate may contain different components, for example, the 24 volt substrate shown in FIGS. 8A and 8B include a single resistor 140, 142 on each face of the substrate respectfully and the 12 volt substrate include two resistors 144, 146 and 148, 150 on each side of the substrate.

The substrate 118 is generally rectangular and includes a first end 152 and a second end 154. Between the first and second ends, tabs 156 project from a side of the substrate 118. The second, lower end 154 is configured to be disposed in the cavity of the base 112. The width of the lower end 154 will be slightly less than the diameter of the threaded portion 133 of the base 112. The lower end 154 will include a positive terminal 158 which will be coupled to the inner terminal 114 of the base via wire 162 (shown in FIG. 6) and a negative terminal 160 which will be electrically coupled to the outer terminal 116 of the base via wire 164 (shown in FIG. 6). The positive and negative terminals will supply power to the driving circuit as described above in relation to FIGS. 3 and 4.

The substrate 118 will include a plurality of mains 132 for supplying the rectifying power from the driving circuit to the LEDs 120. The mains 132 will be configured as wide copper lines to facilitate the dissipation of heat generated by the plurality of LEDs. Preferably, a solder mask will be applied to the surfaces of the substrate over the mains 132 to reflect light from the substrate. The solder mask may be white, amber, copper, etc. in to give a warmer color to the light being reflected off the substrate and thus more resembling an incandescent bulb.

The plurality of LEDs 120 will be mounted to the first upper end 152 of the substrate 118 to generate light in the same manner as a conventional incandescent light bulb, e.g., in 360 degree or a spherical output. Three LEDs are mounted on each side or face of the substrate and two LEDs are mounted on a top edge 152 of the first upper end 152. Referring to FIG. 9A, the edge 152 will include a notch 165 for each LED to be mounted on the edge 152. By providing the notch 165, the LED mounted on the edge 152 will come into contact with three surfaces of the substrate providing greater stability for mounting the LED. The LED configuration shown replicates the light output of a conventional incandescent light bulb. The light output for the embodiment shown throughout the figures is about 73 foot candles (fc) from the top of the bulb 10, about 85 to about 90 fc from the sides of the bulb 10 and about 70 to about 80 fc from the bottom of the bulb 10.

Once the substrate 118 is assembled with the plurality of LEDs, the substrate will be electrically coupled to the base as described above. The lower end 154 will be disposed in the threaded portion 133 of the base and the tabs 156 of the substrate 118 will come to rest on the skirted portion 134 of the base. As will be described below, the cover 122 will come into contact with the tabs 156 securing the substrate within the bulb 110.

Figure 10:
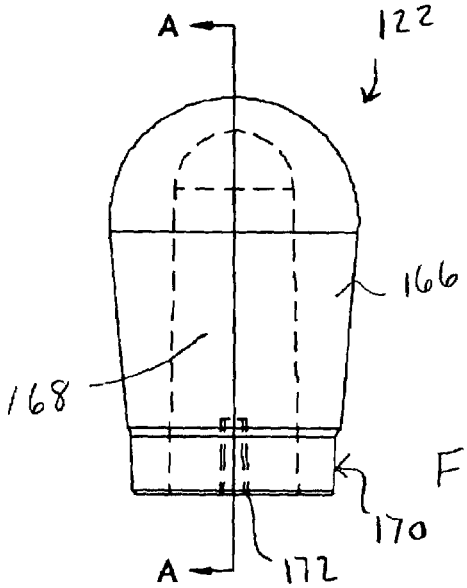
FIG. 10 is a side view of a cover of the LED light bulb of FIG. 5.
Figure 10A:
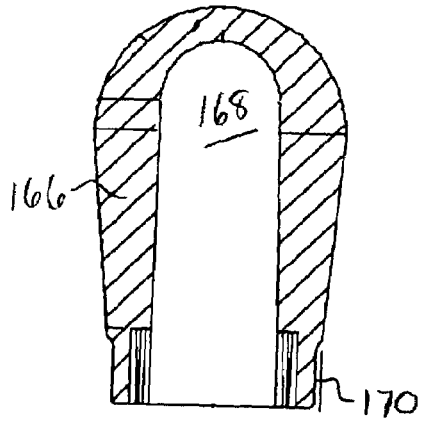
FIG. 10A is a cross sectional view of the cover of FIG. 10 taken along line A-A.
Figure 10B:
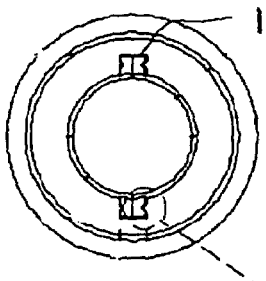
FIG. 10B is a bottom view of the cover of FIG. 10
Figure 10C:
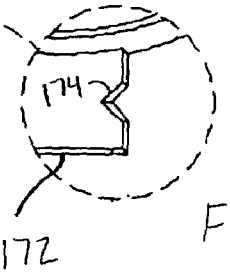
FIG. 10C is an enlarged view of a slot of the bottom of the cover.

Referring to FIGS. 10 and 10A, a cover or lens 122 will be coupled to the base 112 enclosing and protecting the substrate and plurality of LEDs. The cover 122 will be formed with a solid wall 166 defining a cavity 168 for receiving the substrate 118. A lower end of the cover 122 will be formed with a recessed portion 170 configured to mate with the skirted portion 134 of the base. The height of the recessed portion 170 will be substantially the same as the height of the skirted portion 134 of the base. The recessed portion allows for more securing mounting in that there is greater surface area in contact with the skirted portion of the base. This additional surface area also permits better bonding of the polycarbonate cover using epoxy or similar methods. The bonding strength is an important consideration for resistance to hand torque forces when installing or removing the bulb from a socket as well as resistance to shock and vibration that could be experienced in outdoor environment. Any known adhesive may be applied to an inner surface of the skirted portion 134 before the recessed portion 170 is inserted. Furthermore, a thermal epoxy may be employed which will transfer heat from the substrate to the base.

The recessed portion 170 of the cover 122 will also include at least two slots 172 for receiving the tabs 156 of the substrate when the cover 122 is mounted to the base 112. Opposing side walls of each slot 172 will include detents 174 for securely gripping the tabs 156 of the substrate.

Preferably, the cover 122 is of a single piece construction formed from a clear polycarbonate by any known conventional technique such as molding, injection molding, etc. Pigments may be added to the polycarbonate to provide light color alteration or enhancement through filtering. In the embodiment shown, the cover 122 is formed with the dimensions of a conventional 6S6 bulb.

Figure 11:
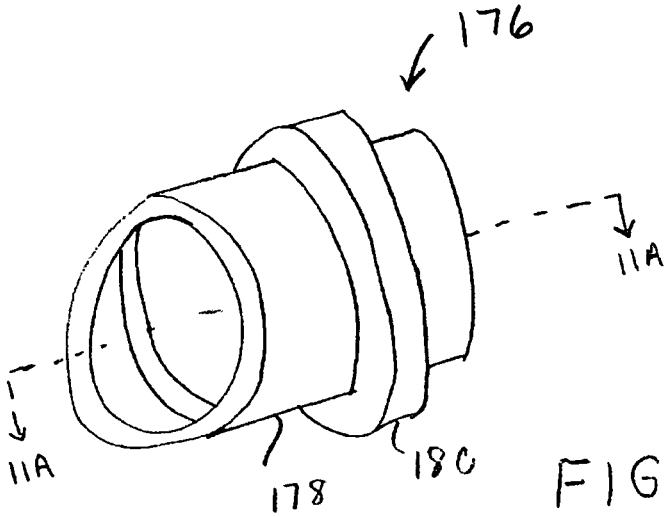
FIG. 11 is a perspective view of a gasket to be employed with the LED light bulb of the present disclosure.
Figure 11A:
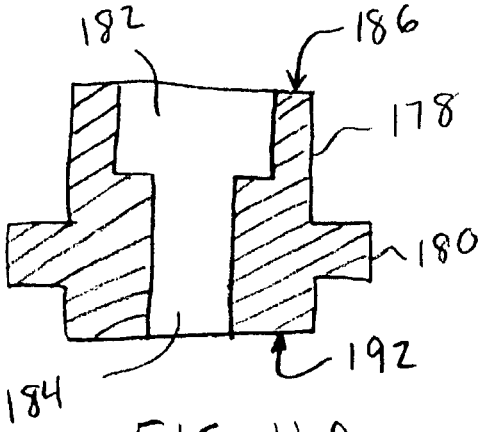
FIG. 11A is a cross sectional view of the gasket of FIG. 11 taken along line A-A.

Referring to FIGS. 11 and 11A, a gasket 176 for environmentally sealing the bulb of the present disclosure to a socket is illustrated. The gasket 176 includes a cylindrical wall 178 with an annular rim 180 configured on a lower portion of the cylindrical wall 178. The wall 178 defines two inner cavity sections for receiving a bulb. An upper cavity section 182 is configured to receive the shirted portion 134 of the base and lower cavity section 184 is configured to receive the threaded portion 133 of the base. The gasket is preferably made form rubber or any known resilient material where the upper cavity section 182 has substantially the same diameter of the skirted portion 134 of the base and the lower cavity section 184 has substantially the same diameter of the threaded section 133, and therefore the base 112 will fit in the gasket in an interference fit. Furthermore, the lip portion 138 of the base will come into contact with an upper edge 186 of the gasket preventing rain and the like from entering between the gasket and the base.

Figure 12:
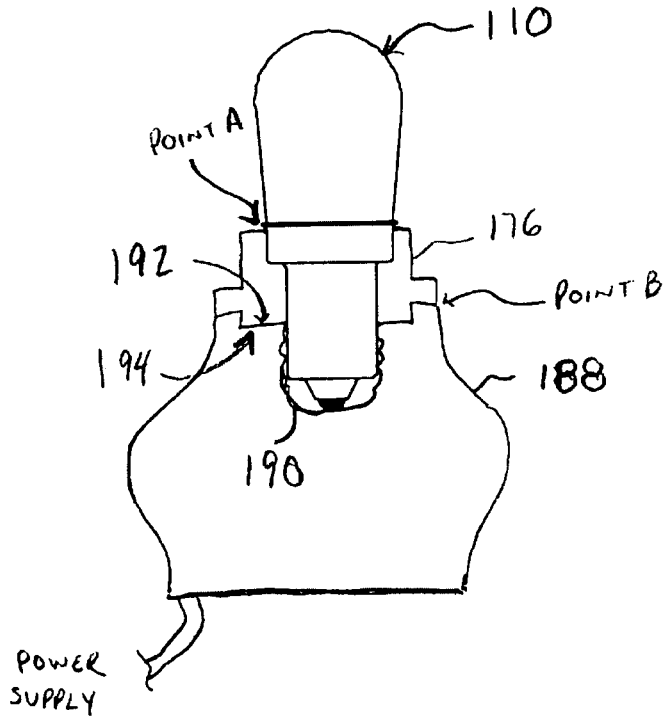
FIG. 12 is a side view of an LED light bulb and gasket according to an embodiment of the present disclosure mounted in a power source.

Referring to FIG. 12, the bulb 110 and gasket 176 are mounted in a socket 188 for supplying power to the bulb, e.g., a Maypo socket. The socket 188 is coupled to a power supply and includes a threaded socket 190 for receiving the base 112 of the bulb. To install the bulb 110, the gasket 176 is placed over the base 112, The base 112 of the bulb is then disposed in the threaded socket 190 wherein the bottom 192 of the gasket comes into contact with an upper peripheral portion 194 of the socket 188. As the bulb is twisted into the socket 188, the gasket 176 is compressed where the lip portion 138 of the base comes into contact with the upper edge 186 of the gasket (point A) and where the bottom 192 of the gasket comes into contact with an upper peripheral portion 194 of the socket 188 (point B). The environmental elements are prevented from entering the socket by the pressure created at these two points, e.g., point A and B.

Figure 13:
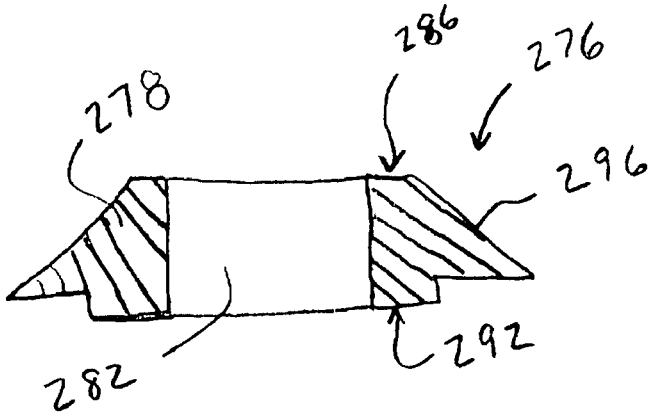
FIG. 13 is a cross sectional view of a gasket according to another embodiment of the present disclosure.

Referring to FIG. 13, another embodiment of a gasket 276 for environmentally sealing the bulb of the present disclosure to a socket is illustrated. The gasket 276 includes a generally cylindrical wall 278 which defines an inner cavity section 282 for receiving a bulb. The cavity section 282 is configured to receive the threaded portion 133 of the base of the bulb. The gasket 276 is configured with a downwardly-outsloping outer wall 296 which slopes outward from a top edge 286 of the gasket to the bottom 292. The gasket is preferably made form rubber or any known resilient material where the cavity section 282 has substantially the same diameter of the threaded section 133, and therefore the base 112 will fit in the gasket in an interference fit.

Figure 14:
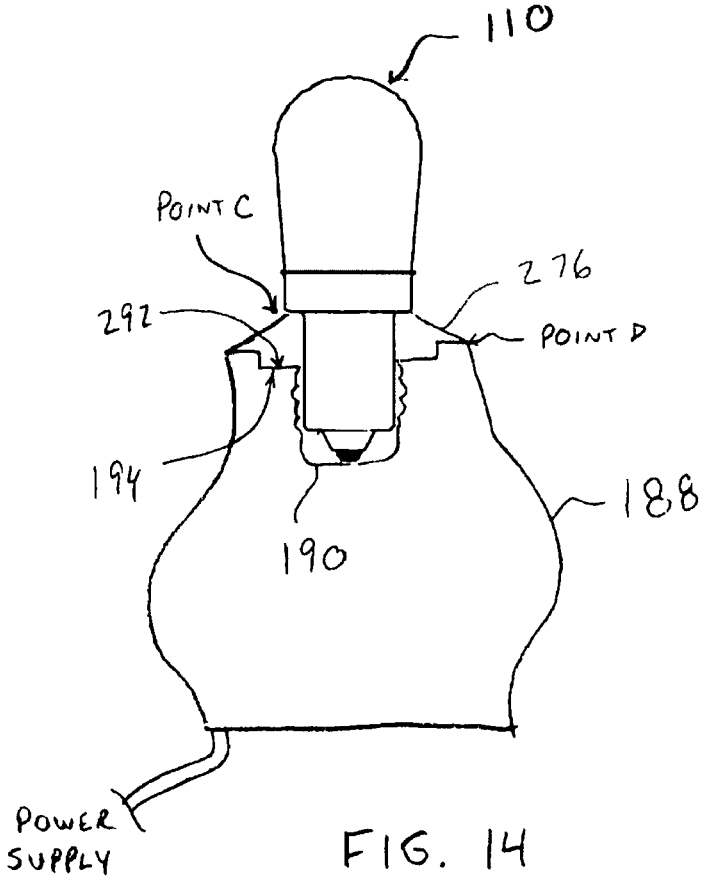
FIG. 14 is a side view of an LED light bulb and gasket of FIG. 13 mounted in a power source.

Referring to FIG. 14, the bulb 110 and gasket 276 are mounted in a socket 188 for supplying power to the bulb, e.g., a Maypo socket. The socket 188 is coupled to a power supply and includes a threaded socket 190 for receiving the base 112 of the bulb. To install the bulb 110, the gasket 276 is placed over the base 112, The base 112 of the bulb is then disposed in the threaded socket 190 wherein the bottom 292 of the gasket comes into contact with an upper peripheral portion 194 of the socket 188. As the bulb is twisted into the socket 188, the gasket 276 is compressed where the skirted portion 134 of the base comes into contact with the upper edge 286 of the gasket (point C) and where the bottom 292 of the gasket comes into contact with an upper peripheral portion 194 of the socket 188 (point D). The environmental elements are prevented from entering the socket by the pressure created at these two points, e.g., point C and D.

A light emitting diode (LED) light bulb has been described. The LED light bulb of the present disclosure has several advantages over conventional incandescent light bulb. For example, the LED light bulb will have a longer life, e.g., 20,000 hours vs. 2,000 hours for incandescent, and will have a lower power consumption (1.05 watts vs. 4.24 watts for an incandescent). Furthermore, in commercial applications, it is not only the energy cost and bulb replacement savings that are beneficial but there is also a savings on the cost of maintenance to access the bulb on a structure and replace it.

While the disclosure has been shown and described with reference to certain preferred embodiments thereof, it will be understood by those skilled in the art that various changes in form and detail may be made therein without departing from the spirit and scope of the disclosure.

What is claimed is:

1. An LED light bulb comprising:

a base for coupling the bulb to a power source having at least one side wall defining a cavity and a skirted portion;

a generally planar rectangular substrate having a first end and a second end, the second end disposed in the cavity and electrically coupled to the base, the substrate including a tab projecting from each side edge located adjacent the second end of the substrate configured for mating with the skirted portion of the base;

a plurality of LEDs electrically coupled and disposed on the first end of the substrate, the plurality of LEDS arranged on a front face, back face and top edge of the first end of the substrate to emit light in a spherical output, wherein the substrate further comprises electrically conducting material disposed on the front face and back face for electrically coupling the base to the plurality of LEDs, wherein the electrically conducting material covers substantially all of the front face and back face for conducting heat away from the plurality of LEDs; and a light transmissive cover configured to enclose the plurality of LEDs, the cover being coupled to the base and further comprises a recessed portion at an open end for mating with the skirted portion of the base, wherein the recessed portion further comprises two slots configured to receive the tabs of the substrate.

2. The LED light bulb as in claim 1, wherein the top edge of the first end of the substrate further comprises at least one notch configured to receive at least one LED.

3. The LED light bulb as in claim 2, wherein each LED is a surface mount device type LED.

4. The LED light bulb as in claim 1, wherein each slot comprises at least one detent for coming into contact with each tab of the substrate.

5. The LED light bulb as in claim 1, wherein a solder mask is disposed on the substrate to reflect light generated by the plurality of LEDs.

6. The LED light bulb as in claim 5, wherein a color of the solder mask is white, copper or amber.

7. The LED light bulb as in claim 1, wherein the substrate comprises at least two layers of insulating material, each layer including electrically conductive material.

8. The LED light bulb as in claim 1, further comprising a cylindrical gasket configured to be disposed on the base, wherein when the bulb is coupled to the power source the gasket environmentally seals the bulb.

9. The LED light bulb as in claim 1, wherein the substrate comprises at least two layers of insulating material, each layer including electrically conductive material.

10. The LED light bulb as in claim 1, wherein a thermal epoxy is disposed at a contact point of the cover and the base, wherein the epoxy transfers heat from the substrate to the base.

11. An LED light bulb comprising:

a base for coupling the bulb to a socket of a power source having at least one side wall defining a cavity, the base including a threaded portion for insertion into the socket and a skirted portion for receiving a cover;

a generally planar rectangular substrate having a first end and a second end, the second end disposed in the cavity and electrically coupled to the base, the substrate including a tab projecting from each side edge located adjacent the second end of the substrate configured for mating with the skirted portion of the base;

a plurality of LEDs electrically coupled and disposed on the first end of the substrate, the plurality of LEDS arranged on a front face, back face and top edge of the first end of the substrate to emit light in a spherical output, wherein the substrate further comprises electrically conducting material disposed on the front face and back face for electrically coupling the base to the plurality of LEDs, wherein the electrically conducting material covers substantially all of the front face and back face for conducting heat away from the plurality of LEDs; and a light transmissive cover configured to enclose the plurality of LEDs, the cover including a recessed portion at an open end for mating with the skirted portion of the base, wherein the recessed portion of the cover further comprises two slots configured to receive the tabs of the substrate.

* * * * *